United States Patent [19]

Krautkremer et al.

[11] Patent Number: 4,519,335

[45] Date of Patent: May 28, 1985

[54] DEVICE FOR CONTROLLING THE DIRECTION OF MOVEMENT AND THRUST FORCE OF A WATERCRAFT

[75] Inventors: Franz Krautkremer; Siegfried Lais, both of Spay; Reinhold Knecht, Rhens; Detlev Stache, Waldesch, all of Fed. Rep. of Germany

[73] Assignee: Schottel-Werft Josef Becker GmbH & Co KG., Spay, Fed. Rep. of Germany

[21] Appl. No.: 503,204

[22] Filed: Jun. 10, 1983

[30] Foreign Application Priority Data

Jun. 11, 1982 [DE] Fed. Rep. of Germany ..... 3222054

[51] Int. Cl.[3] ..... B63H 25/42

[52] U.S. Cl. ..... 114/144 R; 114/144 E; 440/53

[58] Field of Search ..... 114/144 R, 144 E; 440/53

[56] References Cited

U.S. PATENT DOCUMENTS 3,976,023 8/1976 Naguchi et al. ..... 114/144 E
4,220,111 9/1980 Krautkremer et al. ..... 114/144 E
4,418,633 12/1983 Krautkremer et al. ..... 114/144 R

FOREIGN PATENT DOCUMENTS 47701 1/1977 Japan ..... 114/144 R
47702 2/1977 Japan ..... 114/144 R

*Primary Examiner*—Sherman D. Basinger
*Attorney, Agent, or Firm*—Flynn, Thiel, Boutell & Tanis

[57] ABSTRACT

A watercraft includes two steerable propellers driven by motors, the angular positions of and the thrusts produced by the steerable propellers being controlled by a control system. The control system includes an input device having a frame, a head and a handwheel supported on the frame for independent pivotal movement about a common first axis, and a lever supported on the head for pivotal movement about a second axis normal to the first axis. The head, handwheel and lever are each operatively coupled to a respective input element by a respective gear arrangement. A microcomputer responsive to the input elements is connected through several control devices to the motor and the steerable propellers for effecting the requisite control thereof.

18 Claims, 35 Drawing Figures

FIG. 2
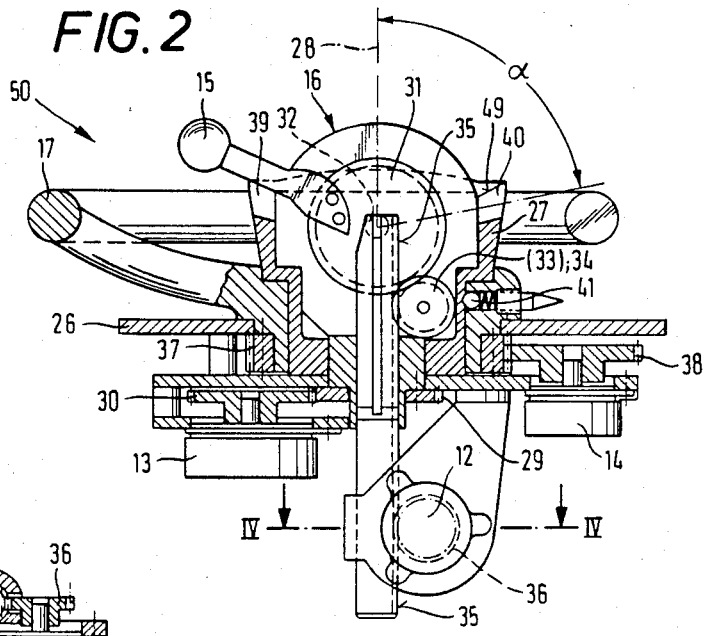
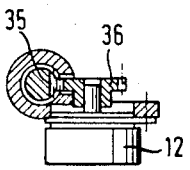
FIG. 4
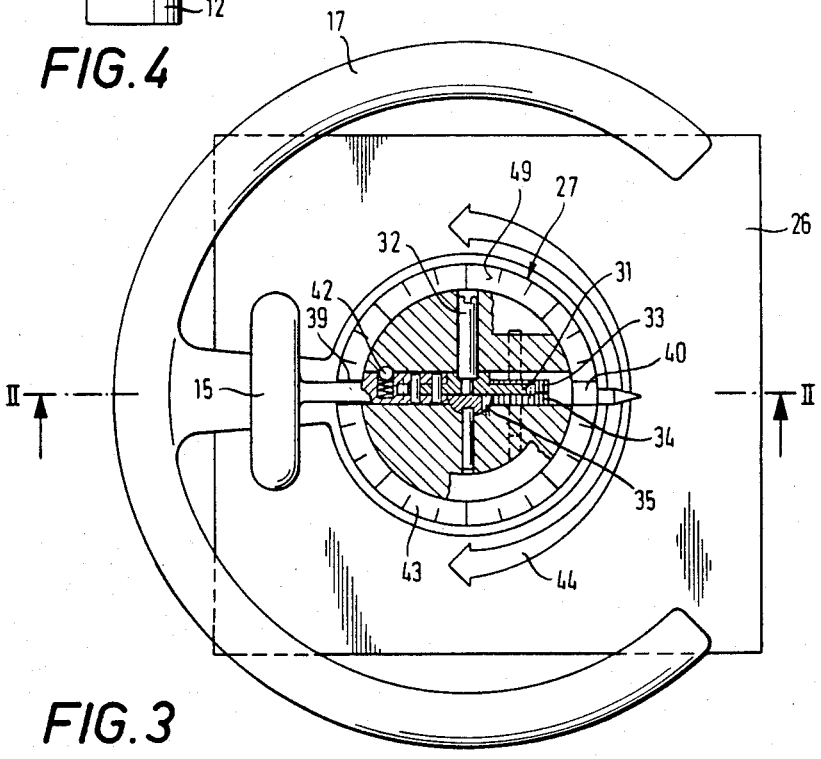
FIG. 3

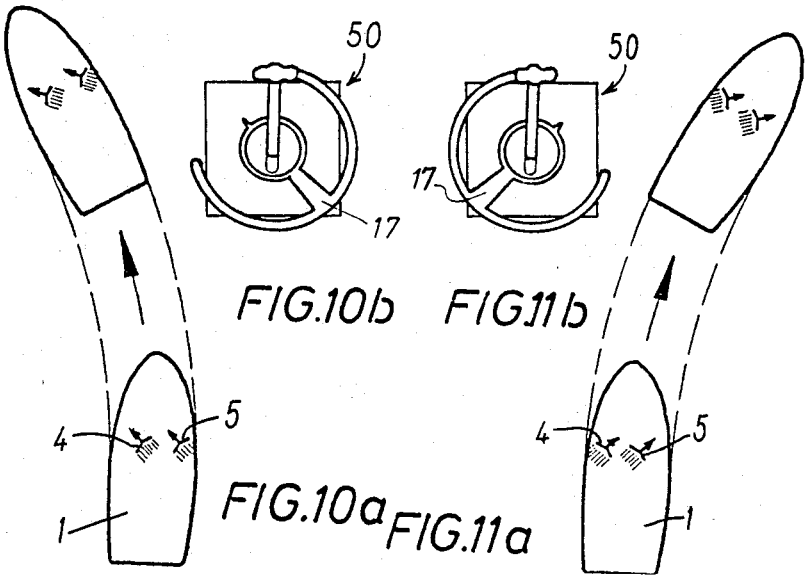
FIG.10b FIG.11b
FIG.10a FIG.11a
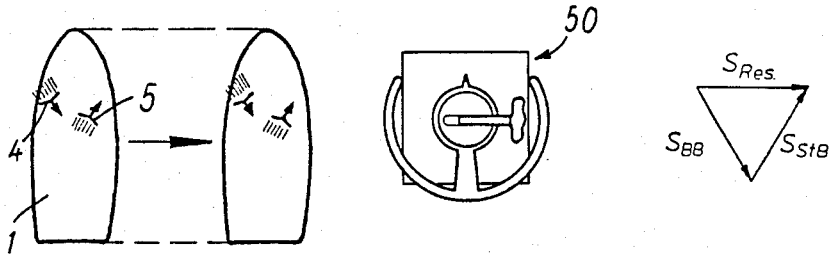
FIG.12a FIG.12b FIG.12c
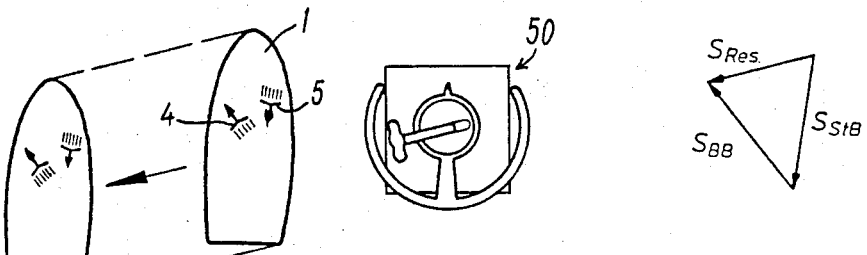
FIG.13a FIG.13b FIG.13c

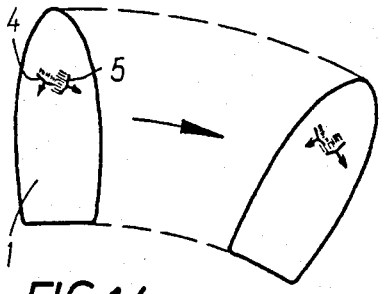
FIG.14a
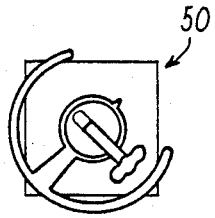
FIG.14b
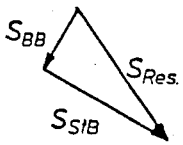
FIG.14c
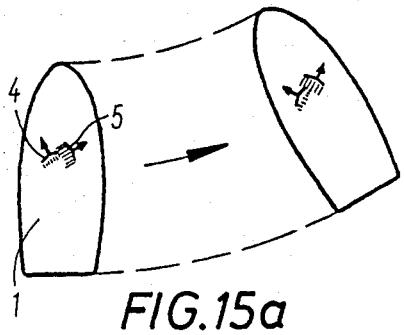
FIG.15a
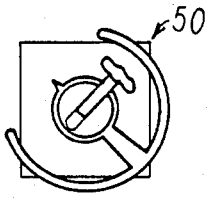
FIG.15b
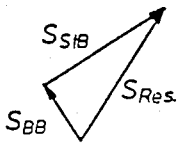
FIG.15c
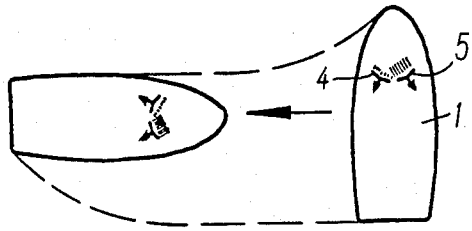
FIG.16a
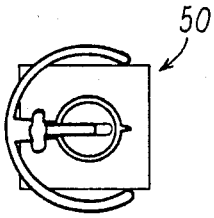
FIG.16b
FIG.16c
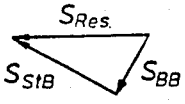

DEVICE FOR CONTROLLING THE DIRECTION OF MOVEMENT AND THRUST FORCE OF A WATERCRAFT

FIELD OF THE INVENTION

This invention relates to a device for controlling a watercraft and, more particularly, to a device for controlling the direction of movement and the force in such direction of a watercraft having at least two thrust generating devices, at least one motor for driving the thrust generating devices, and an input device which can control rotation of the watercraft, linear movement of the watercraft, and the thrust forces which produce these movements.

BACKGROUND OF THE INVENTION

In the sense of the invention, the term thrust generating devices includes all drive members suitable for the mechanical drive of a watercraft, for example a steerable propeller, a jet drive, a cycloidal propeller and others.

Devices of the foregoing type are already known, for example a control device with a single lever which is supported in two crosswise arranged members which are rotatable about perpendicularly arranged axes, which members operate electrical circuits which control a pair of steerable propellers. If the lever is deflected in any direction which does not lie on an axis of rotation of the members all senders are operated. (See U.S. Pat. No. 3,976,023).

Also, a device of the above-mentioned type is known with which a watercraft can be controlled for rotational and linear movement by means of a lever. The control impulses are forwarded from the lever through sending devices to the thrust generating devices, which serve several functions. They are effective both for linear and also rotational movement of the watercraft. (See German Offenlegungsschrift No. 30 13 654, which corresponds to U.S. Pat. No. 4,418,633).

When two or more functions are combined with a common lever, and a control element thus serves several functions, it is hardly possible to control a change in the direction of travel without necessarily changing the effective thrust strength. If the helmsman wants to carry out only a single control function, he must have great sensitivity and experience in order to do so in a precise manner. In the conventional devices, the effective thrust of the steerable propellers or other thrust generating devices is in some circumstances, for example during forward travel, stronger than that with the same control lever inclination in other circumstances, such as transverse travel. The reason is that, in any desired direction of movement other than straight forward or backward, the thrusts of the steerable propellers are always directed at least partially against one another, namely, at different angles.

It is a purpose of the invention to avoid the described problems, or in other words to provide a device for driving and controlling watercraft and the like with which all conceivable maneuvers and movements can be carried out, for example travel straight ahead and back, rotation along any desired curve and in any desired direction or in one spot, and also transverse movement, if desired with superposed rotation, and in which the required thrust strengths can in each case always be predicted for the helmsman without unintentional changes occurring during adjusting of the presetting lever.

A further very important purpose is to prevent control settings from being inadvertently selected which might endanger the watercraft.

A further purpose of the invention is to make it clear positionally and visibly at the input device, namely, on the lever, handwheel or the like, which direction and thrust strength have been selected for the watercraft. Only through this does an indication for thrust reversal for stopping the vehicle by means of the input device become possible, or at least easier.

SUMMARY OF THE INVENTION

The purposes of the invention are met by providing a device which includes a first input element for defining the force of a linear movement of the watercraft, a second input element for defining the direction of such linear movement, and a respective control member operatively coupled to each such input element.

Particularly advantageous is a development of the invention which includes a third input element and associated control member for defining the direction and magnitude of a rotational movement of the watercraft. Through these characteristics, all movements of the watercraft are cleanly separated from one another at the input device.

A further very important development of the invention involves the provision of a microcomputer responsive to the input elements. Due to the fact that, for each function of movement, a separate input element is provided which is not influenced by the other input elements, the microcomputer can control the thrust for linear movement, the direction of linear movement, the direction of rotation, and the magnitude of rotation. Furthermore, additional maneuvering devices can be provided, for example lateral thrust rudders. If jet drives are used, then not only their rotation, but also their valves or the like can be controlled. In the case of cycloidal propellers, the wings can be adjusted. Moreover, the microcomputer can regulate the drive motor or any clutches and, if desired, adjust the propeller blade pitch.

Through a further feature which includes a locking arrangement, a very dangerous control error can be avoided, namely, that during full speed forward travel a lateral thrust is inadvertently selected.

A simple and central combination of the final control elements in one unit results from the control member for the second input element being a head supported for pivotal movement about a first axis and operating the second input element through a gear arrangement, the control member for the first input element being a lever pivotally supported on the head for movement about a second axis normal to the first axis and operatively connected to the first input element by a gear and rack arrangement, and including a handwheel supported for rotation about a third axis and operatively connected by a gear arrangement to a third input element. This arrangement is further improved if the first and third axes are coincident. These characteristics are further improved, in order to avoid the above-mentioned inadvertent and dangerous control situation, by providing a frame having slots which receive the lever when the thrust producing devices are each producing a force substantially in a common direction which is parallel to the center plane of the watercraft. In order for the thrust in forward and backward directions to be carried out with a greater force than during traversing, and so that the helmsman gets a feeling for these relationships, the invention can be developed so that the maximum possible movement of the lever from its initial position is larger when the watercraft is being moved in purely forward and reverse directions than in any other direction.

The invention makes it possible for the helmsman to quickly carry out all conceivable maneuvers without having to worry about motor speed, propeller pitch or thrust direction. The watercraft movements can thus be carried out with a precision which is not possible with a manual control, even when operated by trained personnel.

BRIEF DESCRIPTION OF THE DRAWINGS

The invention is discussed in detail in connection with the drawings, which include FIGS. 1 to 16*c*.

In the drawings:

FIG. 2 is a sectional side view of an input device which is a component of the embodiment according to FIG. 1, and is taken along line II—II in FIG. 3;

FIG. 3 is a fragmentary top view of the input device of FIG. 2;

FIG. 4 is a sectional view taken along the line IV—IV of FIG. 2;

FIGS. 7*a* to 16*a* are diagrammatic top views of the watercraft of FIG. 1 showing various directions of movement of the watercraft caused by different orientations of and relative amounts of thrust produced by two thrust generating devices thereon;

FIGS. 7*b* to 16*b* are diagrammatic top views of the input device of FIG. 2 showing the positions of the controls on the input device which correspond to the watercraft movement shown in FIGS. 7*a* to 16*a*, respectively;

FIGS. 8*c*, 9*c* and 12*c* to 16*c* are vector diagrams which illustrate the resultant force produced by the orientations of and relative thrusts of the thrust generating devices shown in FIGS. 8*a*, 9*a* and 12*a* to 16*a*, respectively, where $S_{Stb}$ and $S_{BB}$ are respectively vectors for the starboard and port thrust generating devices and $S_{Res}$ is the resultant vector;

DETAILED DESCRIPTION

Figure 1:
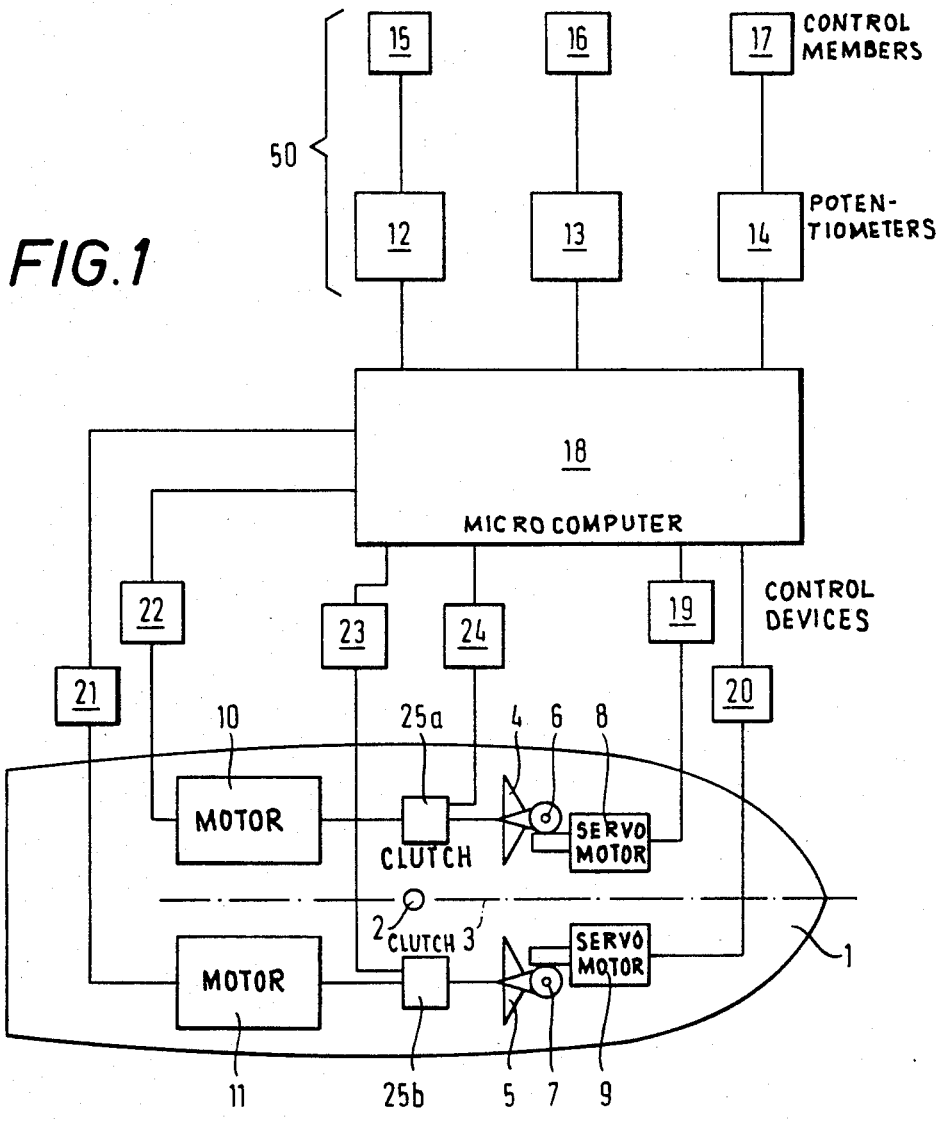
FIG. 1 is a block diagram of the entire arrangement of a watercraft control system embodying the invention.

FIG. 1 is a block diagram of a preferred arrangement of a system for driving and controlling a watercraft 1, the center of gravity of which is identified by reference numeral 2. On opposite sides of the vertical center plane 3 of the watercraft are provided two steerable propellers 4 and 5 which are conventional and therefore not described in detail, and which are supported for pivotal movement in a conventional manner about respective vertical swivel axes 6 and 7 and can be pivoted about such axes by servomotors 8 and 9. Two motors 10 and 11 are provided to effect propeller rotation. Between the motors 10 and 11 and the steerable propellers 4 and 5 are provided respective clutches 25*a* and 25*b*.

To control the drive system, an input device 50 is provided and includes three input elements 12, 13 and 14 which, in the preferred embodiment, are potentiometers controlled by respective manually engageable control members 15, 16 and 17.

The first potentiometer 12 is operated by a lever 15 and, through a microcomputer 18, changes the thrust strength by adjusting the angular position of the steerable propellers 4 and 5, by changing the speeds of the motors 10 and 11, and/or by changing the pitch of the propeller blades, as shown in FIGS. 7*a* to 9*a*.

The second potentiometer 13 is operated by a head 16 and, through the microcomputer 18, controls rotation-free transverse movement of the watercraft by pivoting the steerable propellers or by changing the speed or pitch of the propeller blades, as shown in FIGS. 12*a* through 13*c*.

The third potentiometer 14 is operated by a handwheel 17 and, through the microcomputer 18, controls the rotation of the watercraft according to the desired direction and degree of rotation, namely, according to a curve radius determined for the rotation. If desired, rotation in one spot can be effected. Examples of rotational movement are shown in FIGS. 10*a*, 14*a* and 16*a*.

The three potentiometers 12, 13 and 14 act onto the microcomputer 18. The outputs of the microcomputer act onto course-dependent control devices 19 to 24. These control devices are conventional. They are typically amplifiers with electronic compensating circuits which adjust output signals from the microcomputer 18 to a form compatible with the control inputs of the devices which are to be controlled, such as servomotors, throttle valves, clutches and so forth. The microcomputer 18 is programmed so that it converts the information from the potentiometers 12–14 into the desired direction of movement (by positioning the steerable propellers) and the desired thrust (by controlling motor speed and/or propeller blade pitch). It calculates the necessary speeds and rudder positions. By means of test calculations, the input and output signals and the program and operating sequence are determined. It is designed in each case to correspond to the particular arrangement of the propellers in the watercraft. For example depending on whether a front drive, a rear drive, or both are provided. If jet drives are used instead of steerable propellers, then the microcomputer 18 controls either the angular positions or, if flaps are present, the flap positions. In the case of cycloidal propellers, control of the wing position can be incorporated into the program. In addition, the program can also control lateral thrust rudders or other maneuvering devices.

For controlling the watercraft, its movement is inventively divided into basically two components, namely, into a linear or rotation-free movement in any desired direction and into a rotational movement. Both components can be calculated separately and can then be superposed to achieve the direction and speed of movement called for by the input device 50.

Figure 17A:
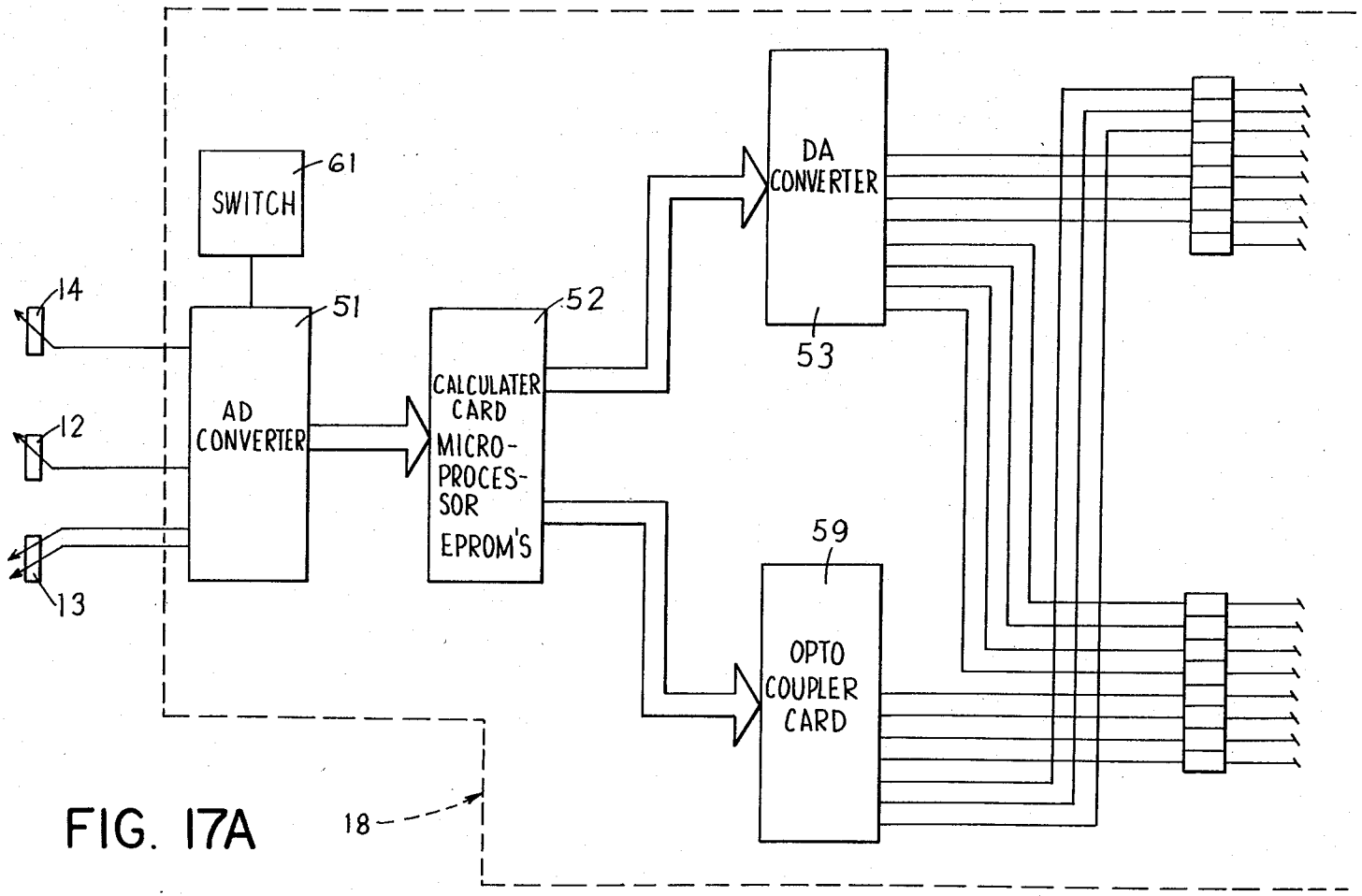
FIGS. 17A and 17B are schematic block diagrams showing respective portions of the control system for the embodiment of FIG. 1 in greater detail.
Figure 17B:
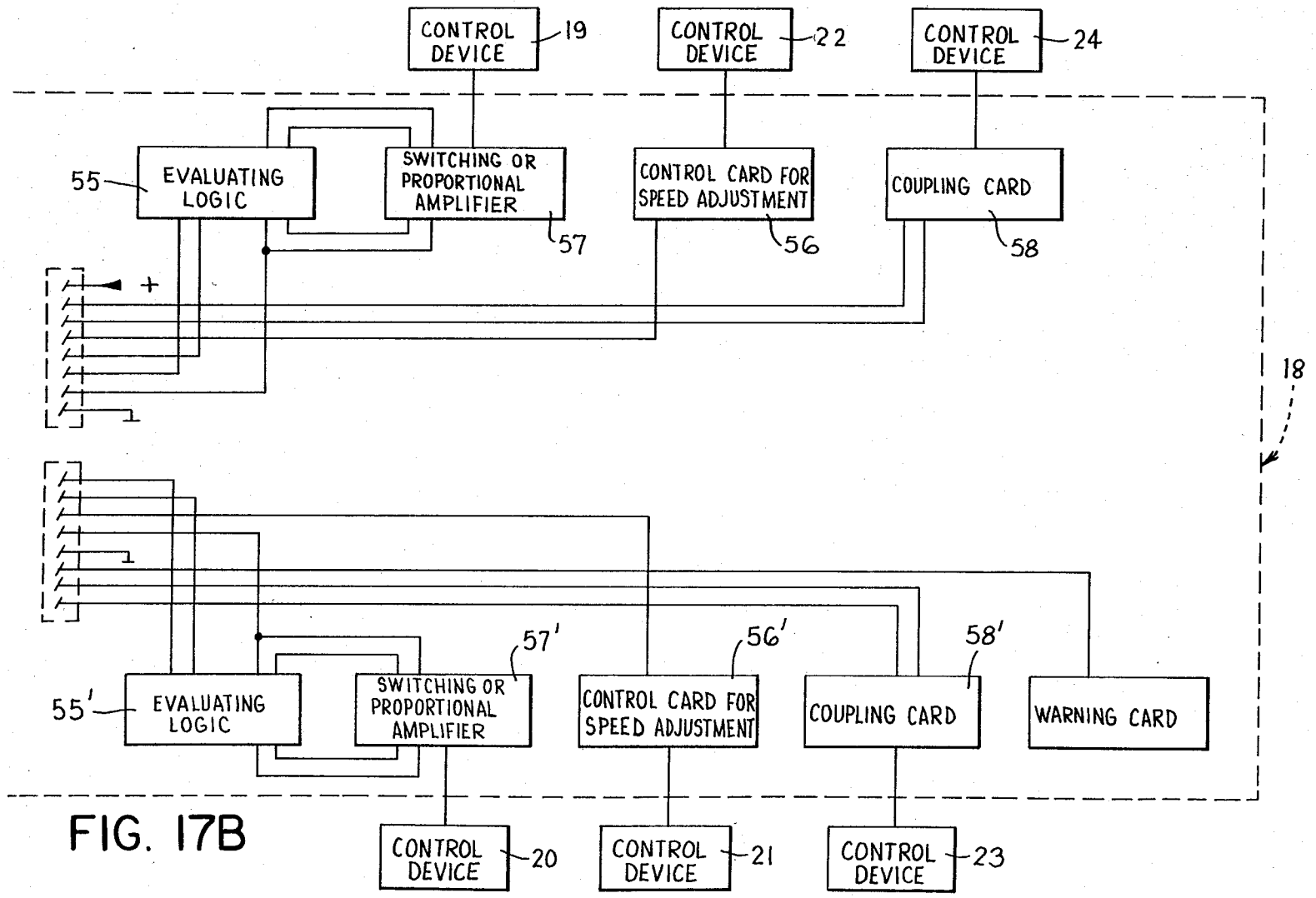

The analog signals of the potentiometers 12, 13, 14 are converted into digital signals in the microcomputer 18 (FIGS. 17A and 17B) by a commercially available, adjusted analog-to-digital converter card 51. From given values of these digital signals, the steerable propeller angles which correspond with these given values and the thrust values, such as motor speed, propeller blade pitch and the like, are calculated on a calculating card 52, namely a microprocessor (for example a module available from the firm Motorola). These calculations are dependent on the arrangement of the steerable propellers in the ship, and in particular on whether for example two steerable propellers are arranged in the front region or the rear region of the ship. Also, other propeller arrangements can be considered. Characteristics of these arrangements are stored in so-called EPROM's. (EPROM's are commercially available parts, which for example are manufactured by the firm Motorola.)

The thus-calculated values are then converted by means of a digital-to-analog converter card 53 into analog signals and are fed to the corresponding electronic cards in a basic apparatus (FIG. 17B) as control signals. This basic apparatus contains evaluating logic circuits 55 and 55', control cards 56 and 56' for speed adjustment, switching or proportional amplifiers 57 and 57' for 360° control of the steerable propellers and/or for adjusting the propellers, coupling cards 58 and 58' for the coupling and brake circuit, and a bus plate.

In addition, the calculator can give signals for the coupling and uncoupling of the steerable propellers, which are forwarded through an opto coupling card 59 to the coupling cards 58 and 58' in the basic apparatus of the microcomputer. (An opto coupling card is an optically coupled isolating circuit located between the computer output and a further circuit, and is commercially available.)

The system can be provided with a switch 61, through which the lateral center of gravity 2 corresponding with the condition of the ship, namely whether empty, half-loaded or fully loaded, can be considered.

Literature is available on which the man skilled in the art can rely for implementing details of the inventive development and the described connections, for example U.S. Pat. No. 4,258,425 or publications of the firm Motorola or the firm Siemens.

FIGS. 2 to 4 illustrate the input device 50, in which the potentiometers 12, 13 and 14 and the control members 15, 16 and 17 are combined. The head 16 is supported for rotation about a vertical axis 28 by a bearing 27 which is fixedly connected to a frame 26. The lever 15 is adapted to facilitate rotation of the head 16. A gear 29 is secured to the lower end of the head 16 and mates with a countergear 30 secured on the drive shaft of the second potentiometer 13.

The head 16 has a central vertical slot and a gear 31 is supported in the slot for rotation about an axle 32 which extends at a right angle to and intersects the axis 28. The lever 15 is secured on the gear 31. The gear 31 mates with an intermediate gear 33 (FIG. 3) which is fixedly connected to a coaxial intermediate gear 34 adjacent to it. The gear 34 mates with a rack 35 which is supported for vertical movement along the first axis 28. The rack 35 mates with a pinion 36 which is secured on the drive shaft of the first potentiometer 12.

The handwheel 17 is supported on the frame 26 for rotation about the first axis 28, and has a gear 37 thereon. The gear 37 mates with a countergear 38 which is secured on the drive shaft of the third potentiometer 14.

The bearing 27 has two slots 39 and 40 in its upper edge which lie diametrically opposite one another and along a line parallel to the center plane 3 of the watercraft. The lever 15 can move into the slots 39 and 40 in its two extreme positions. Important positions of the control elements 15, 16 and 17 can be defined by spring biased locking balls which engage detents, as at 41 and 42. The top surface of the bearing 27 serves as a sliding surface 49 for the lever 15, and is interrupted by the slots 39 and 40. Through this, the angle $\alpha$ of the lever 15 in the pure forward and backward directions is larger than in all other directions. The consequence is that, for pure forward or backward travel, a greater thrust force is applied than in all other directions, and the helmsman feels this. A scale 43 is provided on the surface 49 of the bearing 27 in order to designate various positions of the head 16. Further, a double arrow 44 is provided on the frame 26 and a pointer 17*a* is provided on the handwheel 17 in order to identify the angle of rotation of $\pm 90°$ of the handwheel 17.

Figure 5:
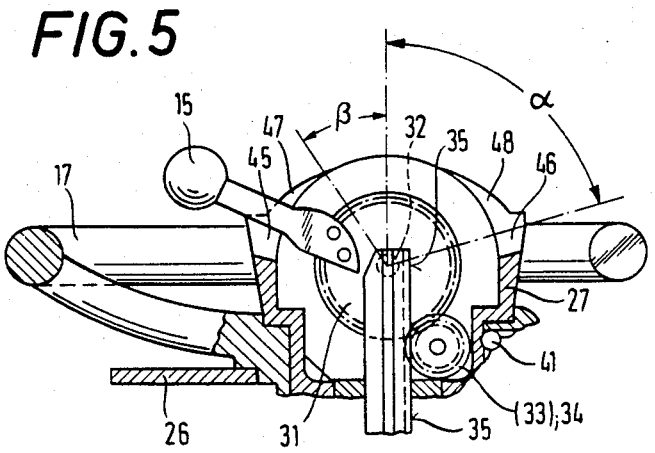
FIG. 5 is a sectional side view similar to FIG. 2 of an alternative embodiment of the input device according to FIG. 2.
Figure 6:
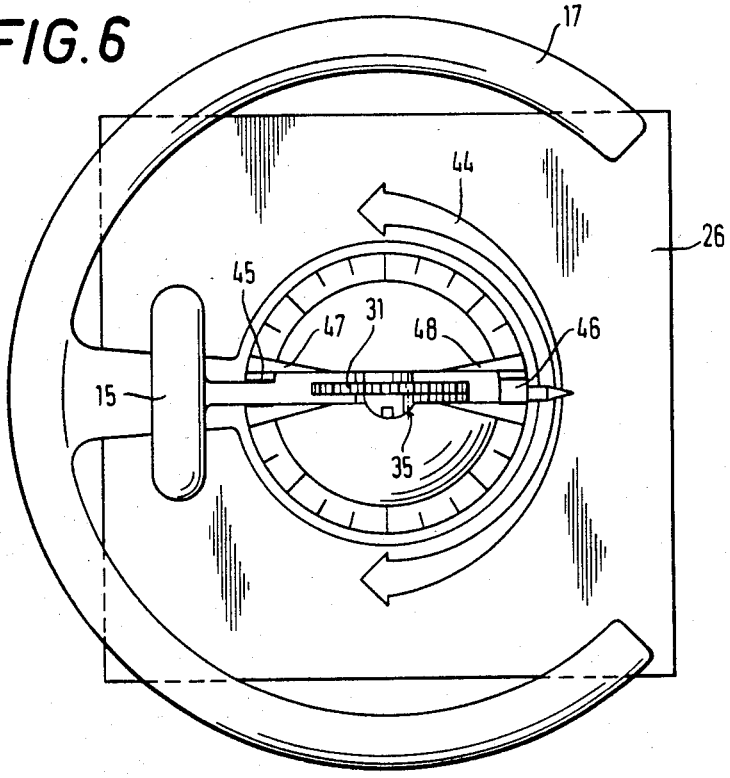
FIG. 6 is a top view of the input device according to FIG. 5.

FIGS. 5 and 6 show a modified version of the input device according to FIG. 2, which modification concerns the slots for receiving the lever 15. In other respects, both input devices are identical. While in the embodiment of FIG. 2 the lever 15 engages the slots 39 and 40 only in its extreme positions, thus preventing rotation of the head 16, in the embodiment according to FIGS. 5 and 6 the corresponding slots 45 and 46 have respective shoulders 47 and 48 on each side thereof which extend radially inwardly above the head. Through this, fixation of the lever 15 relative to the head 16 first occurs at an angle $\beta$ of the lever 15 which is much smaller than the angle $\alpha$.

Figure 7A:
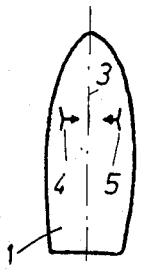

FIGS. 7*a* through 16*c* illustrate the relationship of the input device 50 to the thrust generating devices, namely, the steerable propellers 4 and 5 (FIG. 7*a*). In FIG. 8*a*, as an example, the arrows indicate the direction of the propeller thrusts and the parallel lines indicate the water flowing away from the propellers, the length of the parallel lines indicating the thrust force.

Figure 7B:
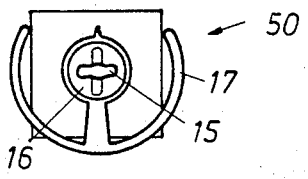
Figure 8A:
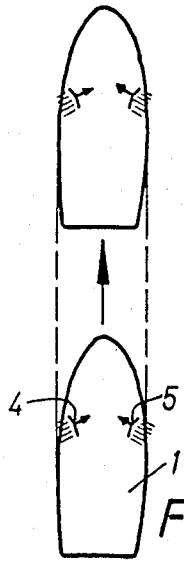
Figure 8C:
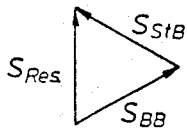
Figure 8B:
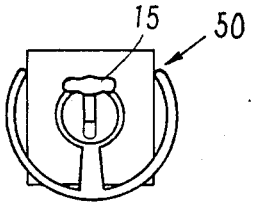
Figure 9A:
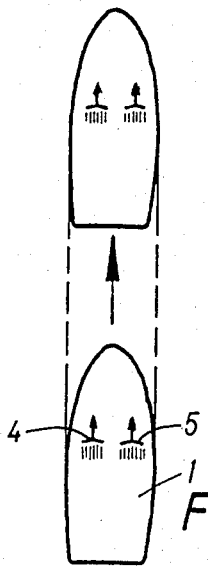
Figure 9C:
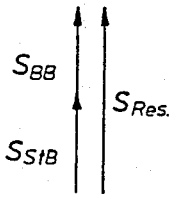
Figure 9B:
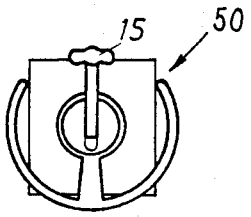

The zero or initial position of the controls is illustrated in FIGS. 7*a* and 7*b*. The lever 15 is positioned vertically along the axis 28, and head 16 and handwheel 17 are aligned for travel in a direction parallel to the center plane 3. The thrust directions of the propellers 4 and 5 are oriented in opposite directions and transversely to the center plane 3 of the watercraft 1. The clutches 25*a* and 25*b* (FIG. 1) are switched off and the watercraft does not travel. If the lever 15, while maintaining the described initial position of the input devices 16 and 17, is swung forwardly as shown in FIG. 8*b*, then the propellers 4 and 5 are started and pivoted a certain amount in opposite directions (FIG. 8*a*), so that a resulting forward thrust (FIG. 8*c*) is produced. The watercraft then starts to travel forwardly. When the lever 15 has covered the full angle $\alpha$, the propellers are positioned parallel with respect to the center plane 3, as shown in FIGS. 9*a*, 9*b* and 9*c*, and the watercraft travels forward at full speed. In this position, the lever 15 is in the slot 40 (FIG. 2) and the head 16 is thus fixed against rotation. It is therefore impossible to move the head 16 and initiate a traversing movement, which would be very dangerous in this condition of movement and speed.

If the watercraft is then to be stopped, the lever 15 is swung back to its initial position. It is also possible to momentarily swing the lever beyond such position. From this results a thrust reversal which causes the watercraft to immediately cease movement in the forward direction of travel. This is true for every rotation-free movement of the watercraft. Backward travel is controlled in a similar manner by moving lever 15 rearwardly.

If the lever 15 is moved from its initial position but the head 16 is not rotated from its initial position, and if the handwheel 17 is then operated, then a rotation is superposed to the watercraft during forward or backward travel, causing it to turn. The microcomputer 18 decides whether the superposition must occur through a change in thrust force and/or a change in the angular position of the thrust generating devices. For approximately oppositely directed thrusts such as those in FIG. 8*a*, superposition is done through a change of thrust force, whereas for parallel thrusts such as those in FIG. 9*a*, a change in the angular position of the thrust generating devices is used.

If the handwheel 17 is maintained in its initial or zero position and the head 16 is rotated, together with the lever 15, about the axis 28, then the thrust generating devices are controlled, by changing angular position and/or thrust force, so that a lateral thrust results in the direction in which the lever 15 points and which can be read on the scale 43, and with a thrust strength which depends on the inclination of the lever 15. See, for example, FIGS. 12*a* through 13*c*. The thrust angles and thrust strengths which are required for such movements depend on the arrangement of the thrust generating devices with respect to the center of gravity of the watercraft and on the dynamic behavior of the watercraft, all of which must be considered when preparing the program for the microcomputer.

In order for the resulting thrust to always correspond with the position of the head 16, suitable thrust angles and thrust strengths are preset in the microcomputer 18. See, for example, the length of the parallel lines which indicate the thrusts behind the respective propellers in FIG. 13*a*.

If, in addition to the control members 15 and 16, the handwheel 17 is also operated, then a rotation of the watercraft is superposed on the traversing movement, examples of which are shown in FIGS. 14*a* through 16*c*.

If the lever 15 is in its initial position and the handwheel 17 is rotated, then the watercraft rotates in one spot.

The entire arrangement for controlling a watercraft can also be such that the control system according to the invention has associated with it, for each thrust generating device, a control device such as a control wheel or gas lever which is not connected to the microcomputer 18, but is connected directly to the thrust generating device in the usual manner. It or the inventive device can be selectively switched on when this is desirous for any reason.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privledge is claimed are defined as follows:

1. A device for controlling the direction of movement and the force in such direction for a watercraft, comprising two thrust generating devices, drive means for driving said thrust generating devices, and an input device which can control rotation of the watercraft about a vertical axis, linear movement of the watercraft in horizontal directions, and the thrust force produced by said thrust generating devices for effecting said rotational and linear movements; wherein said input device includes a first input element for defining the force for linear movement of the watercraft and a second input element for defining the direction of linear movement of the watercraft; wherein said first and second input elements are each controlled by a respective control member; wherein said control member for said second input element is a head which can be pivoted about a stationary first axis and operates said second input element through a first gear arrangement; wherein said control member for said first input element is a lever which is pivotally supported on said head for movement about a second axis which extends at a right angle to said first axis, said lever being operatively connected by a second gear arrangement to a longitudinally movably supported rack which operates said first input element through a pinion; and including a handwheel which is supported for rotation about a third axis and is operatively connected by a third gear arrangement to a third input element.

2. The device according to claim 1, wherein said third input element defines the direction and magnitude of rotation of the watercraft.

3. The device according to claim 1, including a microcomputer which is responsive to said input elements and controls servomotors which control the directions in which thrust is produced by said thrust generating devices.

4. The device according to claim 3, wherein said microcomputer controls the amount of thrust produced by said thrust generating devices.

5. The device according to claim 1, wherein said control member for said second input element, during movement of said watercraft in purely forward and backward directions and starting at a predetermined position of said control member for said first input element, is locked against movement in order to prevent transverse movement of the watercraft.

6. The device according to claim 1, wherein said third axis is coincident with said first axis.

7. The device according to claim 1, including a frame which is provided with at least one slot which can receive said lever when said thrust generating devices are in positions in which each provides a thrust which is directed parallel to a center plane of the watercraft.

8. The device according to claim 1, including a microcomputer which is responsive to said input elements and controls clutches provided between said drive means and said thrust generating devices.

9. The device according to claim 1, wherein the maximum amount of movement of said control member for said first input element away from an initial position thereof is larger when said watercraft is moving in purely forward and backward directions than in any other direction.

10. An apparatus for controlling the direction of movement and the force in this direction for a watercraft, comprising: two thrust generating devices which are each pivotal about a respective vertical axis; drive means for driving said thrust generating devices; and an input device for controlling rotation of the watercraft about a vertical axis, linear movement of the watercraft in horizontal directions and the magnitude of forces produced by said thrust generating devices for effecting said rotational and linear movements; wherein said input device includes a first control member which is supported for pivotal movement about a first axis and is coupled through a first gear arrangement with a first input element which controls the direction of linear movement of the watercraft, a second control member which is supported for pivotal movement about a second axis and is coupled through a second gear arrangement to a second input element which controls the force produced by said thrust generating devices for effecting linear movement of the watercraft, and a third control member which is supported for pivotal movement about a third axis and is coupled through a third gear arrangement to a third input element which controls the direction of rotational movement of the watercraft and the force produced by said thrust generating devices for effecting rotation of the watercraft.

11. The apparatus according to claim 10, wherein said second control member is movably supported on said first control member.

12. The apparatus according to claim 10, wherein said second gear arrangement includes a movable rack which extends approximately parallel to said first axis.

13. The apparatus according to claim 10, wherein said third axis is coincident with said first axis.

14. The apparatus according to claim 10, wherein said first control member, during travel in purely forward and backward directions and starting at a predetermined position of said second control member, is locked against movement in order to prevent transverse movement of the watercraft.

15. The apparatus according to claim 10, including a frame which has a slot which can receive said second control member when said thrust generating devices are in positions in which each provides a thrust which is directed parallel to a center plane of the watercraft.

16. The apparatus according to claim 10, wherein the maximum amount of movement of said second control member away from an initial position thereof is larger when said watercraft is moving in purely forward and backward directions than in any other direction.

17. The apparatus according to claim 10, including a microcomputer which is responsive to said input elements and controls servomotors which in turn control pivotal movement of said thrust generating devices.

18. An apparatus for controlling the direction of movement and the force in this direction for a watercraft, comprising: two thrust generating devices which are each pivotal about a respective vertical axis; drive means for driving said thrust generating devices; and an input device for controlling rotation of the watercraft about a vertical axis, linear movement of the watercraft in horizontal directions and the magnitude of forces produced by said thrust generating devices for effecting said rotational and linear movements; wherein said input device includes a manually operable head and a manually operable handwheel which are supported for independent pivotal movement about a first axis and are respectively operatively coupled to first and second input elements, said first input element controlling the direction of linear movement of the watercraft and said second input element controlling the direction of rotational movement of the watercraft and the force produced by said thrust generating devices for effecting rotation of the watercraft, and wherein said input device includes a manually operable lever which is supported on said head for pivotal movement about a second axis substantially perpendicular to said first axis and is operatively coupled to a third input element which controls the force produced by said thrust generating devices for effecting linear movement of the watercraft.

* * * * *